US010309034B1

(12) United States Patent
Yoo

(10) Patent No.: US 10,309,034 B1
(45) Date of Patent: Jun. 4, 2019

(54) METAL BLOCK FOR FLUID TRANSPORTATION

(71) Applicant: UNILOK Corporation, Incheon (KR)

(72) Inventor: Myoung Ho Yoo, Seoul (KR)

(73) Assignee: UNILOCK CORPORATION, Incheon (KR)

( * ) Notice: Subject to any disclaimer, the term of this patent is extended or adjusted under 35 U.S.C. 154(b) by 0 days.

(21) Appl. No.: 15/923,248

(22) Filed: Mar. 16, 2018

(30) Foreign Application Priority Data

Feb. 5, 2018 (KR) ..... 10-2018-0014110

(51) Int. Cl.

| | |
|---|---|
| ***C25F 3/24*** | (2006.01) |
| ***C23F 17/00*** | (2006.01) |
| ***C23C 8/26*** | (2006.01) |
| ***C23C 8/80*** | (2006.01) |

(52) U.S. Cl.
CPC ..... *C25F 3/24* (2013.01); *C23C 8/26* (2013.01); *C23C 8/80* (2013.01); *C23F 17/00* (2013.01)

(58) Field of Classification Search
CPC ..... C25F 3/24; C23C 8/26; C23C 8/50
See application file for complete search history.

(56) References Cited

U.S. PATENT DOCUMENTS 5,605,179 A 2/1997 Strong, Jr. et al.

FOREIGN PATENT DOCUMENTS

JP 05156351 A 6/1993

OTHER PUBLICATIONS

Naoki Yasumaru, "Low-Temperature Ion Nitriding of Austenitic Stainless Steels", Department of Mechanical Engineering, Fukui National College of Technology, Sabae, Fukui 916-8507, Japan, Materials transactions. 1998., vol. 39, No. 10, pp. 1046-1052.

*Primary Examiner* — Jessee R Roe
(74) *Attorney, Agent, or Firm* — Dinsmore & Shohl LLP; Yongsok Choi, Esq.

(57) ABSTRACT

Provided are a method for manufacturing a metal block which has a complex shape and can maintain a firm sealed unit even when it is repeatedly assembled and the metal block according thereto. To achieve the objective, the present disclosure performs a first electrolytic polishing of the metal block made of stainless steel having a chromium oxide layer, forms an ion-nitrided layer by carrying out an ion-nitriding process, performs a second electrolytic polishing to efficiently remove part of the ion-nitrided layer and induces complex diffusion of high-concentration surface N and C in order to surface-harden a surface layer having a precipitate phase. Accordingly, the present disclosure can increase hardness of the sealed unit inside the metal block up to Hv 400 or more with its corrosion resistance kept, thereby effectively sealing metal.

5 Claims, 4 Drawing Sheets

METAL BLOCK FOR FLUID TRANSPORTATION

CROSS-REFERENCE TO RELATED APPLICATIONS

This application claims priority to Korean Patent Application No. 10-2018-0014110, filed on Feb. 5, 2018, the entire contents of which are herein incorporated by reference.

BACKGROUND OF THE DISCLOSURE

Field of the Disclosure

The present disclosure relates to a metal block for fluid controls which is used for semiconductor equipment, power generation facilities, offshore plants, airplanes and the like, more particularly surface treatment of a metal block.

Description of the Background Art

A metal block in a fluid control system using gas or liquid refers to a block which connects various valves, regulators, gaskets and the like and is a very important sealing component for an apparatus which uses a fluid having toxicity, corrosiveness and the like (Refer to FIG. 7). Such a metal block is an important component connecting the control unit and the piping unit of a valve package which controls reactant gases in a semiconductor process so that the reactant gases can be supplied and shut out. Conventionally, such a metal block is improved in terms of corrosion resistance by increasing the portion of a chromium oxide layer, as in FIG. 1, by means of electrolytic polishing, where a metal matrix of SS 316L is electrolytically polished so that CrO:FeO ratio is kept 2:1 or more in terms of thickness.

Although a sealed unit of the metal block having such a structure can be fastened repeatedly by controlling the sealed unit to have a hardness of about Hv 300 after being electrolytically polished, corrosion can occur due to the concentration gradient of nitrogen in precipitates formed by electrolytic polishing, which accounts for the issue that leaks occur at a sealed part when the sealed unit is repeatedly assembled in the metal block. In particular, a material which has been severely forged or drawn has, due to the nature of the material, its crystal grains stretched caused by precipitation, which brings about a local part whose corrosion resistance deteriorates.

Finally, although the metallic sealed unit maintains its vacuum level with the help of seal firmness by hardening the surface using a physical tool such as burnishing tools, repeated assembly inhibits the sealed unit from performing a high vacuum level.

Cases are reported where ion-nitriding is employed to resolve such problems but fails to do so. In such cases, a stainless steel matrix is nitrided at high temperature, as in FIG. 2, to form an ion-nitrided layer for attempting to make a product. Although the surface should be polished in its ordinary process, it is difficult to apply polishing when the sealed unit has a complex shape.

Korean Patent Registration No. 10-1237915 discloses a method of shot peening treatment after nitriding. However, such a technique cannot be applied to a product having a complex shape as described above.

SUMMARY OF THE DISCLOSURE

The present disclosure is for providing a method for manufacturing the metal block which has a complex shape and can maintain the firm sealed unit even when it is repeatedly assembled and the metal block according thereto.

To achieve the objective, the present disclosure hardens the surface of a layer in which a precipitation phase exists by efficiently removing part of the ion-nitrided layer and inducing complex diffusion of surface N (Nitrogen) and C (Carbon) at high concentration by ion-nitriding the metal block made of stainless steel having the chromium oxide layer and then electrolytically polishing the metal block for the sake of effectively sealing metal by increasing the hardness of the sealed unit of the metal block up to Hv 400 or more with its corrosion resistance kept.

Surface treatment of still higher quality can be achieved in the described method by electrolytically polishing the metal block also before forming the ion-nitrided layer.

According to the present disclosure, because the metal block is made of stainless steel having high machinability, it is possible to manufacture an exquisite shape in a relatively easy way, achieve surface cleanness through a first electrolytic polishing of the metal block and considerably increase corrosion resistance by forming the ion-nitrided layer therein and then performing a second electrolytic polishing to polish the surface layer of the ion-nitrided layer slightly, thereby removing precipitates which can promote corrosion to prevent galvanic corrosion and by reacting residual chromium into the chromium oxide layer. Accordingly, the metal block provided by the present disclosure can maintain high reliability due to its high corrosion resistance even when used for treating toxic gas or corrosive fluids, exhibit high hardness and high corrosion resistance even when various units are fastened to the metal block and operate stably and safely.

DETAILED DESCRIPTION OF THE DISCLOSURE

Embodiments according to the present disclosure will be described in more detail hereinafter with reference to the accompanying drawing.

Figure 3:
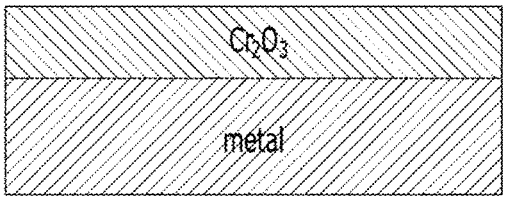
FIG. 3 is a cross-sectional view of a structure of the chromium oxide layer formed by electrolytic polishing.

The metal block provided by the present disclosure, made of stainless steel having high machinability and low hardness, is formed into the shape of the metal block and has both high hardness and high corrosion resistance through the first electrolytic polishing, the ion-nitriding and the second electrolytic polishing. When electrolytically polishing stainless steel, the surface of the stainless steel having the chromium oxide layer in its surface layer is polished, as in FIG. 3, to reduce the chromium oxide layer, thereby enhancing its surface cleanness. Electrolytic polishing of a forged material can cause corrosion due to S-phase precipitates. In particular, a material which has been severely forged or drawn has, due to the nature of the material, its crystal grains stretched, which brings about a local part whose corrosion resistance deteriorates.

According to the present disclosure, forged stainless steel with high hardness is manufactured into the metal block, part of the surface of the metal block is polished by using electrolytic polishing, the thick nitriding layer is formed even when carbon and nitrogen precipitates are partially diffused by inducing complex diffusion of carbon and nitrogen through the ion-nitriding and the surface layer is polished again. The second electrolytic polishing removes the surface layer in which precipitates are formed and makes the surface polished, maintaining a diffusion-hardened layer and a combined layer.

More specifically, the chromium oxide layer of the stainless steel is trimmed and made thin through the first electrolytic polishing, the surface hardness gets higher by forming the ion-nitrided layer thick and the chromium oxide layer is formed by removing the precipitates, which are formed on the surface due to the ion-nitriding process and can induce corrosion, through the second electrolytic polishing and, simultaneously, by reacting chromium residual in the surface of the ion-nitrided layer into chromium oxide in order to enhance corrosion resistance of the metal block.

The metal block according to the present disclosure maintains a surface hardness of Hv 400 to Hv 600 under 300 g, thereby achieving a high vacuum level and has a long service life for maintaining its sealing performance because the metal block does not go through fluid-inducing corrosion even when any unit transporting toxic or corrosive fluids is repeatedly fastened to the metal block. The metal block with low hardness is depressed in the part pressurized under the gasket through high-vacuum sealing behaviors to impair its high-vacuum sealing performance, thereby shortening service life of the metal block whereas the metal block according to the present disclosure is not involved in such a problem because the highly hardened part of the metal block is thicker.

Figure 1:
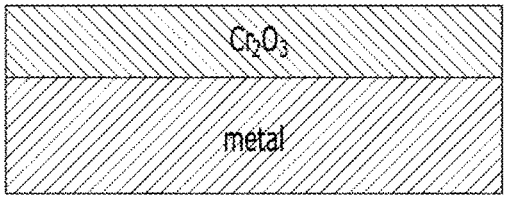
FIG. 1 shows a laminated structure formed after surface treatment of the metal block manufactured according to an existing technique.
Figure 2:
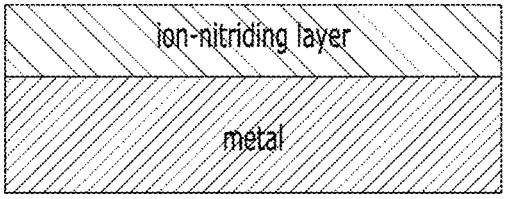
FIG. 2 shows a laminated structure formed after surface treatment of the metal block manufactured according to an existing technique.
Figure 4:
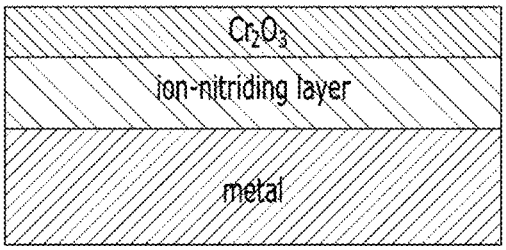
FIG. 4 is a cross-sectional view showing the matrix and the surface-treated laminated structure of the metal block according to the method for manufacturing the metal block of the present disclosure.

In other words, the metal block in FIG. 4 is, different from that of FIG. 1, which illustrates an existing product, has the chromium oxide layer in its surface layer, wherein N and C are excessively injected into the stainless steel matrix to the maximum concentration by employing the ion-nitriding method in the sealed part in order to maintain its crystal lattice to the fullest possible extent and not to lower its corrosion resistance.

(Cr,Fe)xNy precipitates during the ion-nitriding process due to excessive concentration of the interstitial elements, N and C. This is characteristic of the present disclosure, wherein, on the contrary to an existing technique, the ion-nitrided layer (N and C high-concentration diffusion layer) is forcibly thickened to high concentration, thereby lengthening the life for which high hardness is maintained with the help of the thickness of the high-hardness layer and a precipitation solid solution layer exposed in the outmost layer of the thickened ion-nitrided layer is removed by means of the second electrolytic polishing and, at the same time, the (Cr,Fe)xNy precipitates are converted into the chromium oxide layer, thereby enhancing corrosion resistance.

The fabricated metal block has high corrosion resistance and reliability to maintain excellent sealing performance even against repeated assembly, which contributes reduction of assembly time and costs of semiconductor equipment, leading to its increased lifetime.

A process of the present disclosure will be described hereinafter in more detail.

Figure 5:
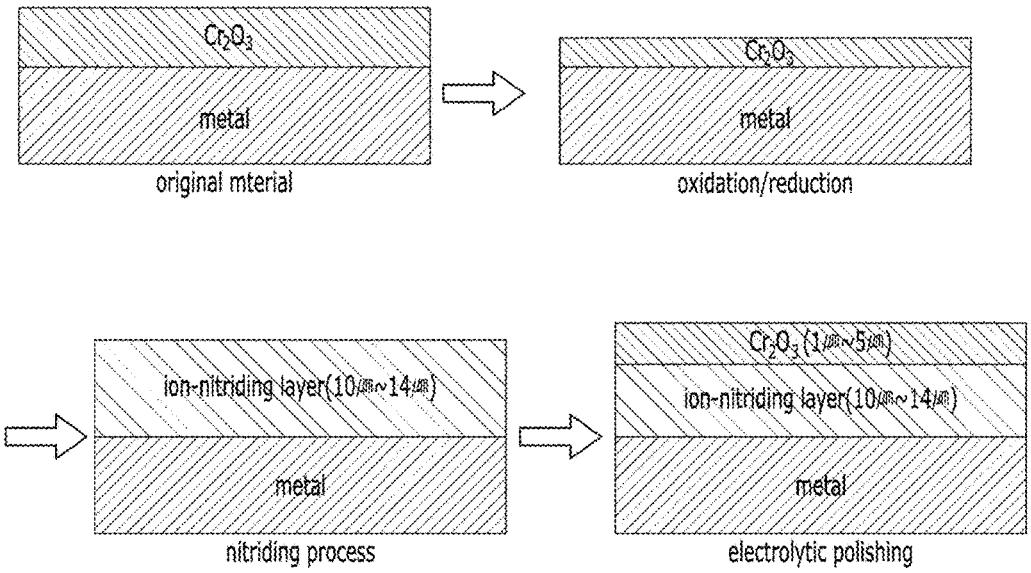
FIG. 5 is a flowchart showing the method for manufacturing the metal block of the present disclosure and results of the surface treatment according thereto.

FIG. 5 is a flowchart schematically describing the process of the present disclosure. The metal block is machined from the stainless steel matrix. The machined metal block is processed through the first electrolytic polishing. Conditions for the electrolytic polishing is as follows: a current density of 5 A/cm$^2$ to 20 A/cm$^2$; a process time of 5 seconds to 40 seconds, desirably 10 seconds to 30 seconds; an electrolyte temperature of 40° C. to 80° C., desirably 60° C. to 70° C.; and an electrode distance of 0.5 mm to 3 mm, desirably 0.5 mm to 1 mm are maintained.

On completing the first electrolytic polishing, the chromium oxide layer of the stainless steel is thinned while the surface cleanness of the stainless steel increases.

Then, ion-nitriding is carried out as an ion plasma process by using low-temperature plasma. The high-concentration diffusion layer is formed at a low temperature between 300° C. and 600° C., desirably 400° C. and 540° C. by injecting nitrogen at 400 to 800 sccm (standard cubic centimeters per minute) (600 sccm for the present embodiment). Process vacuum level is 0.1 Torr to 1 Torr (0.4 Torr for the present embodiment) while electric energy is 10 kW to 30 kW (18 kW for the present embodiment).

In the ion-nitriding, hydrogen gas is flowed at a velocity of 400 to 800 LPM (Liter Per Minute) at 100° C. to 350° C. so that nitrogen can diffuse at high velocity at high concentration, wherein temperature is increased slowly and gradually and, depending thereon, electric current applied to an ion source is increased slowly and gradually from 5 A to up to 20 A. Once temperature reaches 400° C. hydrogen and nitrogen are flown simultaneously, wherein flow rates of the two species are be 400 LPM to 800 LPM while current is further increased between 20 A and 25 A. The conditions are maintained for from 200 minutes to 400 minutes. After that temperature is increased to 500° C. so that hydrogen flows while current is decreased a little bit, which is maintained for 60 minutes to 100 minutes. After that the process proceeds for more 10 minutes to 60 minutes with nitrogen flowing. Temperature is decreased down to about 300° C. thereafter, which is kept for 10 minutes to 40 minutes. In the final phase of the process, temperature is decreased to room temperature or about 80° C. while hydrogen is flowed, which is maintained for about 40 minutes to 80 minutes and then the process is completed. The process temperature and the applied current are controlled so that they have a positive correlation while the process proceeds for the longest time in the phase where hydrogen and nitrogen are flowed simultaneously.

The formed ion-nitriding layer has a thickness of 10 μm (micrometer) to 40 μm and part of the ion-nitriding layer is converted into the chromium oxide layer by means of the second electrolytic polishing in order to enhance corrosion resistance, wherein the chromium oxide layer has a thickness of 1 μm to 5 μm to enhance its surface hardness and corrosion resistance. Conditions for the second electrolytic polishing are identical to those of the described first electrolytic polishing.

Figure 6:
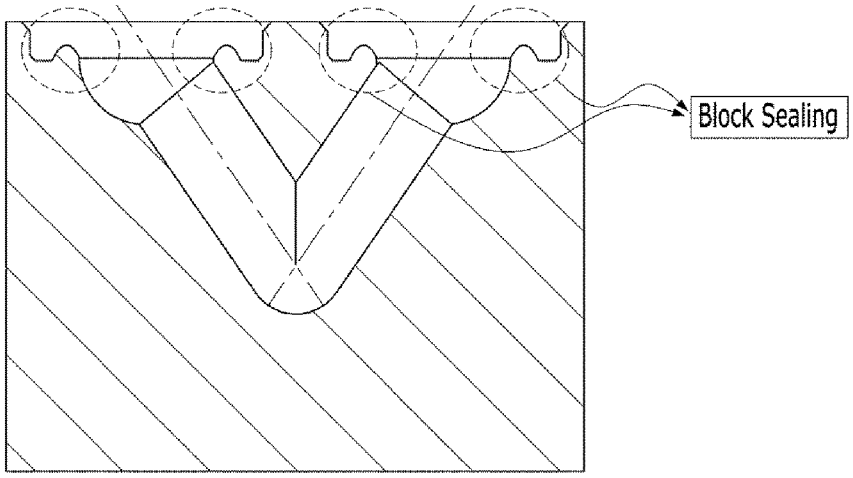
FIG. 6 is a cross-sectional view showing the sealed part of the metal block and for describing burnishing treatment according to the present disclosure.
Figure 7:
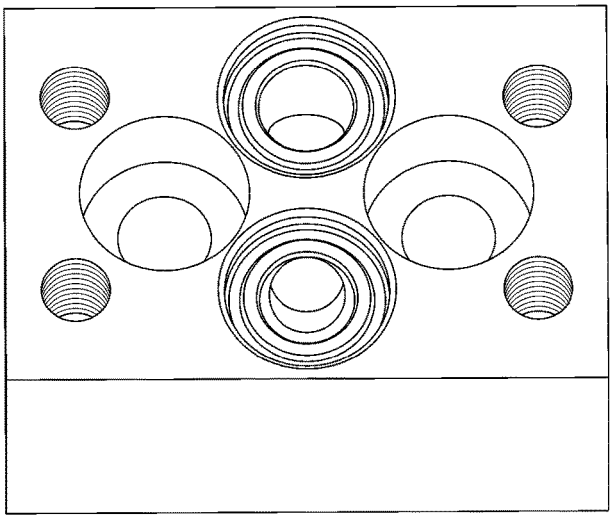
FIG. 7 is a photograph of the metal block applied to the fluid control system.

Corrosion resistance is enhanced and high gloss is obtained through the second electrolytic polishing. The first electrolytic polishing can be omitted conditionally. In addition, the burnishing treatment can be carried out prior to the electrolytic polishing to increase illumination and hardness, which can be applied to both the first and the second electrolytic polishing. In other words, the portion of the metal block where the block is sealed (Refer to FIG. 6) has increased illumination and hardness by physically burnishing after machining. Here, it is desirable to have an illumination of Ra 0.15 or less and a hardness of Hv 300 or less.

Apart from the metal block of the present disclosure, the described process can be applied to various metallic components which should require high hardness and corrosion resistance and have an exquisite shape.

Description thus far is nothing but exemplary and it should be understood a person skilled in the art can modify and change the present disclosure within the scope thereof. Embodiments in the present Specification are used just for describing the technical thoughts of the present disclosure and not for limiting them. The scope of the technical thoughts of the present disclosure should not be limited by such embodiments. Therefore, the scope of rights of the present disclosure should be construed by the scope of the Claims and all technical thoughts within the scope should be construed as included in the scope of rights of the present disclosure.

The present invention was created from support of Koran Ministry of Trade, Industry and Energy (the assignment number, 10062288).

What is claimed is:

1. A metal block manufactured by a manufacturing method comprising:

machining a sealing component having a predetermined shape made of a stainless steel matrix having a chromium oxide layer;

forming an ion-nitrided layer by performing an ion-nitriding process on the sealing component; and electrolytically polishing the sealing component having the formed ion-nitrided layer to form an additional chromium oxide layer.

2. The metal block of claim 1, wherein the manufacturing method comprises first electrolytically polishing the sealing component prior to the forming the ion-nitrided layer.

3. The metal block of claim 2, wherein the manufacturing method further comprises burnishing the sealing component prior to the first electrolytically polishing or the electrolytically polishing the sealing component having the formed ion-nitrided layer.

4. The metal block of claim 1, wherein the ion-nitrided layer is formed to have a thickness of 10 μm to 40 μm and then, by performing the electrolytically polishing, the additional chromium oxide layer is formed to have a thickness of 1 μm to 5 μm.

5. The metal block of claim 1, wherein the ion-nitrided layer is formed as a complex diffusion layer of nitrogen, N, and carbon, C.

* * * * *